US007421869B2

(12) United States Patent
Osada

(10) Patent No.: US 7,421,869 B2
(45) Date of Patent: Sep. 9, 2008

(54) CYLINDER LOCK DEVICE

(75) Inventor: Shunichi Osada, Kanagawa (JP)

(73) Assignee: Alpha Corporation, Yokohama (JP)

( * ) Notice: Subject to any disclaimer, the term of this patent is extended or adjusted under 35 U.S.C. 154(b) by 326 days.

(21) Appl. No.: 11/215,072

(22) Filed: Aug. 31, 2005

(65) Prior Publication Data

US 2006/0042335 A1 Mar. 2, 2006

(30) Foreign Application Priority Data

Sep. 1, 2004 (JP) ..... P.2004-254916
Sep. 1, 2004 (JP) ..... P.2004-254917

(51) Int. Cl.
*E05B 27/06* (2006.01)

(52) U.S. Cl. ..... 70/358; 70/359; 70/494; 70/409

(58) Field of Classification Search ..... 70/358, 70/359, 378, 493, 419, 395, 398, 405, 409, 70/494

See application file for complete search history.

(56) References Cited

U.S. PATENT DOCUMENTS

| | | | | | |
|---|---|---|---|---|---|
| 3,722,240 | A * | 3/1973 | Spain et al. | ..... | 70/494 |
| 4,098,103 | A * | 7/1978 | Raskevicius | ..... | 70/494 |
| 4,103,526 | A * | 8/1978 | Surko, Jr. | ..... | 70/494 |
| 4,208,894 | A * | 6/1980 | Surko, Jr. | ..... | 70/494 |
| 4,635,455 | A * | 1/1987 | Oliver | ..... | 70/494 |
| 4,998,426 | A * | 3/1991 | Genakis | ..... | 70/494 |
| 5,123,268 | A * | 6/1992 | Eizen | ..... | 70/359 |
| 5,131,249 | A * | 7/1992 | Baden et al. | ..... | 70/398 |
| 5,289,709 | A * | 3/1994 | Field | ..... | 70/494 |
| 5,533,369 | A * | 7/1996 | Valdajos-Gallego | ..... | 70/493 |
| 5,570,601 | A * | 11/1996 | Field | ..... | 70/409 |
| 5,682,779 | A * | 11/1997 | Dolev | ..... | 70/494 |
| 5,943,890 | A * | 8/1999 | Field et al. | ..... | 70/493 |
| 6,257,033 | B1 * | 7/2001 | Ziv-Av | ..... | 70/494 |
| 6,490,898 | B1 * | 12/2002 | Mottura | ..... | 70/495 |
| 6,508,091 | B1 * | 1/2003 | Donatini | ..... | 70/359 |
| 6,912,881 | B2 * | 7/2005 | Kleinhaeni | ..... | 70/409 |
| 7,086,259 | B2 * | 8/2006 | Almoznino | ..... | 70/359 |
| 7,159,424 | B2 * | 1/2007 | Widen | ..... | 70/409 |
| 2003/0037579 | A1 * | 2/2003 | Wu | ..... | 70/358 |
| 2006/0207304 | A1 * | 9/2006 | Widen | ..... | 70/494 |

FOREIGN PATENT DOCUMENTS

| | | |
|---|---|---|
| JP | 07-030641 B | 4/1995 |
| JP | 2003-129710 A | 5/2003 |

* cited by examiner

*Primary Examiner*—Suzanne D Barrett
(74) *Attorney, Agent, or Firm*—Arent Fox LLP

(57) ABSTRACT

Tumbler pins 2 are movably housed in a plug 1. A locked/unlocked state is determined by the turning position on the moving direction center axes of the tumbler pins 2. An unlocking key 4 to be inserted into the plug 1 is provided with unlocking code forming recesses 3 for determining the turning positions of the tumbler pins at code decision positions. The tumbler pins 2 are provided at their leading end portions with drive portions 5, which have slope sides of conical faces gradually reduced in diameter toward the leading ends and having rotational centers offset from the moving direction center axes. The side wall faces of the unlocking code forming recesses 3 are formed of conical faces having rotational centers substantially aligned with those of the conical faces forming the slope sides of the drive portions 5. At code decision positions, the slope sides of the drive portions 5 are forced to contact with the side wall faces of the unlocking code forming recesses 3 thereby to determine the turning positions of the tumbler pins 2.

10 Claims, 11 Drawing Sheets

CYLINDER LOCK DEVICE

The present application claims foreign priority based on Japanese Patent Application Nos. P.2004-254916 filed on Sep. 1, 2004, and P.2004-254917 filed on Sep. 1, 2004, the contents of which are incorporated herein by reference.

BACKGROUND OF THE INVENTION

1. Field of the Invention

The present invention relates to a cylinder lock device.

2. Related Art

JP-A-2003-129710 discloses a cylinder lock using pin tumblers. The cylinder lock of JP-A-2003-129710 is formed by housing individual pin tumblers in a plug and a cylinder case. When a genuine unlocking key is inserted into the plug, boundaries of the pin tumblers move to a turning boundary of the plug in accordance with a depth of unlocking code forming recesses formed in the unlocking key, so that the key can be turned in the plug.

However, a discrimination of the key depends exclusively on the depths of the key code forming recesses. In order to increase different locking codes, therefore, what can be done is to increase the kinds of depths of the key code forming recesses or to increase the number of the key code forming recesses. As a result, the cylinder lock, as disclosed in JP-A-2003-129710, cannot be increased the number of different locking codes drastically.

On the other hand, JP-B-07-030641 discloses a cylinder lock, in which tumbler pins in a plug are turned by a predetermined angle on moving center lines by an unlocking key so that the locked/unlocked state is determined according to turning positions. In the cylinder lock of JP-B-07-030641, the tumbler pins are cut into V-shape at their leading ends and are held turnably on longitudinal center lines. The unlocking key is provided with slits, in which the slits to have the leading ends of the tumbler pins fitted therein are arrayed at angles of intersection varied with respect to the longitudinal axis.

When the unlocking key is inserted into the plug, the leading ends of the tumbler pins are so horizontally turned to a predetermined angle as to be fitted in the slits of the unlocking key. In case this state coincides with the set angle, side rods (or side bars) closing the turning boundary with the cylinder case can retract into the plug so that the key can be turned in the plug.

However, the cylinder lock of JP-B-07-030641 is defective in that the unlocking key can be copied merely by tracing the cut angles of the original key.

SUMMARY OF THE INVENTION

One or more embodiments of the present invention provide a cylinder lock capable of increasing different locking codes.

Moreover, one or more embodiments of the present invention provide a cylinder lock device, for which an unlocking key is hard to copy.

According to one or more embodiments of the present invention, a cylinder lock is provided with: a cylinder case; a cylindrical plug turnably inserted into the cylinder case; a tumbler pin held in the plug and enabled to proceed into the cylinder case and to turn on a moving direction center axis; a drive pin held in the cylinder case and enabled to proceed into the plug and to turn on the moving direction center axis; a first cylindrical curvature face formed at an end portion of the tumbler pin to contact with the drive pin and having a radius of curvature equal to a diameter of the plug and a center of curvature on a rotational center line of the plug; and a second cylindrical curvature face formed on an end portion of the drive pin to contact with the tumbler pin and coextending with the first cylindrical curvature faces.

The cylinder lock is formed by inserting the plug having the tumbler pins fitted therein, turnably into the cylinder case having the tumbler pins fitted therein. The tumbler pins and the drive pins are so arranged in tandem at an initial turning position of the plug that the tumbler pins can enter into the cylinder case while moving the drive pins backward and that the drive pins can enter the plug while pushing the tumbler pins. The drive pins and the tumbler pins are provided, at the end portions on the side of the tumbler pins and at the end portions on the side of the drive pins, respectively, with curvature faces substantially coincident with the turning boundary cylindrical faces between the plug and the cylinder case. At the initial turning position of the plug, the two members are so arranged in tandem as to contact with the curvature face.

When the boundary between the tumbler pins and the drive pins coincides in this state with the turning boundary of the plug, the plug can turn with respect to the cylinder case. If the tumbler pins and the drive pins turn horizontally at that position, on the other hand, the leading ends of the drive pins proceed to the plug side over the turning boundary of the plug, and the leading ends of the tumbler pins also proceed to the side of the cylinder case. As a result, the turning boundary is closed so that the plug cannot be turned.

Even if, therefore, the drive pins and the tumbler pins have identical height positions but different turning positions, the turning boundary between the plug and the cylinder case is not opened so that the locked/unlocked state can be set. As a result, many different locking codes by the turning angle can be formed to increase their number.

According to one or more embodiments of the invention, moreover, the moving direction center axes are offset from the turning center of the plug. This enlarges the height difference of the tumbler pins due to the turns. Even at a small turning angle, therefore, the height for closing the turning boundary between the plug and the cylinder case is increased to improve the locking reliability.

The operation to turn the tumbler pins is performed by inserting the plug into the unlocking key. This unlocking key is provided with unlocking code forming recesses for turning the tumbler pins to predetermined turning positions. For the unlocking code forming recesses and the corresponding leading end shapes of the tumbler pins, a suitable combination can be adopted if the tumbler pins can be guided to predetermined horizontal turning positions. In case the leading ends of the tumbler pins have a chisel shape, for example, the unlocking code forming recesses are formed into grooves for fitting those leading ends so that the angle of the grooves determines the turning positions of the tumbler pins.

According to one or more embodiments of the invention, moreover, the cylinder lock is further provided with drive portions formed at the end portions of the tumbler pins on the sides of key insertion portions and having conical faces gradually reduced in diameter toward the leading ends. A rotational centers of the conical faces are offset from the moving direction center axis. The drive portions turn the tumbler pins when they are pushed onto conical recesses having rotational centers substantially aligned to the rotational centers of the conical faces of the drive portions. As the tumbler pins are varied to a predetermined turning angle, the drive portions move on the circumferential walls of the unlocking code forming recesses to the final contact positions while sequentially changing the contact positions from the contact starting point. As a result, in case the unlocking code forming recesses are to be copied, the contact starting points are indefinite, because they are determined by the initial turning positions of the tumbler pins, and are unknown because the final contact points are determined by the set codes. Therefore, all the circumferential walls have to be copied, thereby to make the copying works difficult.

According to one or more embodiments of the invention, moreover, there is provided a cylinder lock device provided with: a cylinder lock having tumbler pins housed movably in a plug and having its locked/unlocked state determined by turning positions around the moving direction center axes of the tumbler pins; and an unlocking key adapted to be inserted into the plug and having unlocking code forming recesses for determining the turning positions of the tumbler pins at code decision positions. The tumbler pins are provided at their leading end portions with conical faces as outer circumferences gradually reduced in diameter toward the leading ends and having rotational centers offset from the moving direction center axes. The unlocking code forming recesses are provided with conical faces as inner circumferences having rotational centers substantially aligned with those of the conical faces of the drive portions. At the code decision positions, the conical faces of the drive portions are forced to contact with the conical faces of the unlocking code forming recesses thereby to determine the turning positions of the tumbler pins.

Here, the invention does not exclude the determination of the locked/unlocked state by the movement along the moving direction center axes of the tumbler pins but contains not only the case, in which the different locking codes are achieved only by the turning positions of the tumbler pins, but also the case, in which both the turning positions and the moving strokes of the tumbler pins are the factors for generating the different locking codes.

A variety of constitutions can be adopted as the method for determining the locked/unlocked state according to the turning positions of the tumbler pins. These adoptions can be achieved by providing the retracting passage of a side bar closing the turning boundary between the plug and the cylinder case, for example, with the turns of the tumbler pins. Moreover, the determination of the locked/unlocked state can be realized by a constitution, in which the turning boundary of the plug is opened only when the tumbler pins are at the predetermined turning positions.

When the unlocking key is inserted into a predetermined position in the plug so that the unlocking code forming recesses reach the code decision positions, the drive portions of the tumbler pins in the plug come into abutment against the circumferential walls of the unlocking code forming recesses. The drive portions are provided with slope sides of conical faces gradually reduced in diameter toward the leading ends and having rotational centers offset from the moving direction center axes. The unlocking code forming recesses are formed of conical inner faces having rotational centers substantially aligned with those of the conical faces of the drive portions. Moreover, the moving direction center axes of the tumbler pins, i.e., the horizontal turning centers do not coincide with the rotational centers of rotating cones. If the slope sides are pushed, therefore, horizontal turning torques are created in the tumbler pins so that the tumbler pins horizontally turn to predetermined positions.

As the tumbler pins are varied to a predetermined turning angle, the slope sides move on the circumferential walls of the unlocking code forming recesses to the final contact positions while sequentially changing the contact positions from the contact starting point. As a result, in case the unlocking code forming recesses are to be copied, the contact starting points are indefinite, because they are determined by the initial turning positions of the tumbler pins, and are unknown because the final contact points are determined by the set codes. Therefore, all the circumferential walls have to be copied, thereby to make the copying works difficult.

In one or more embodiments of the invention, as has been described hereinbefore, the component force, as established on a generating line of a rotating cone, in the turning direction is utilized for turning the tumbler pins. For this utilization, it is sufficient to set the contact segments (or the slope sides) to be pushed onto the curvature faces of the unlocking code forming recesses. As a result, the slope sides may be exemplified by ridges of a polyhedron. In case, however, the slope sides are formed into the conical faces of rotating cones, they abut in face-to-face relation against the circumferential walls of the unlocking code forming recesses so that their actions are smooth. Moreover, the slope sides may have curved lines such as arcs.

According to one or more embodiments of the invention, a cylinder lock is provided with: a plug including a key insertion portion longitudinally thereof at a center portion and tumbler pins movable in directions into and out of the key insertion portion and turnable on the moving direction center; a cylinder case having the plug turnably inserted thereinto and including drive pins for applying an urging force toward the protruding side of the key insertion portions to the tumbler pins when the plug is at the initial turning position; and a locking portion for opening/closing the turning boundary between the plug and the cylinder case in accordance with the turning positions of the tumbler pins. The tumbler pins are provided, at their end positions on the side of the key insertion portions, with drive portions having conical faces gradually reduced in diameter toward the leading ends and having rotational centers offset from moving direction center axes.

As described above, the locking portion may be modified in various manners by utilizing the side bars. The locking portion includes contact side end portions between the tumbler pins and the drive pins, and the contact end face between the tumbler pins and the drive pins is formed of the curvature face coincident with the cylindrical turning boundary between the plug and the cylinder case. In this case, the side bar or the like can be eliminated to simplify the constitution.

According to one or more embodiments, moreover, an unlocking key to be inserted into a plug of a cylinder lock, in which tumbler pins are movably housed in the plug so that a locked/unlocked state is determined by the turning positions of the tumbler pins on the moving direction center axes, comprises: unlocking code forming recesses, and the unlocking code forming recesses are formed into conical faces having rotational centers in a plurality of rows parallel to the insertion direction of the unlocking key into the plug.

In this case, the rotational centers of the conical faces of the unlocking code forming recesses are arranged on one selected in a predetermined order from three rows, which are aligned at their center with the projection line in the moving direction of the tumbler array. With this arrangement, it is easy to manage the codes and the manufacture of the unlocking key.

Other aspects and advantages of the invention will be apparent from the following description and the appended claims.

DESCRIPTION OF THE PREFERRED EMBODIMENTS

Embodiments of the invention will be described with reference to the accompanying drawings.

Embodiment 1

Figure 1A:
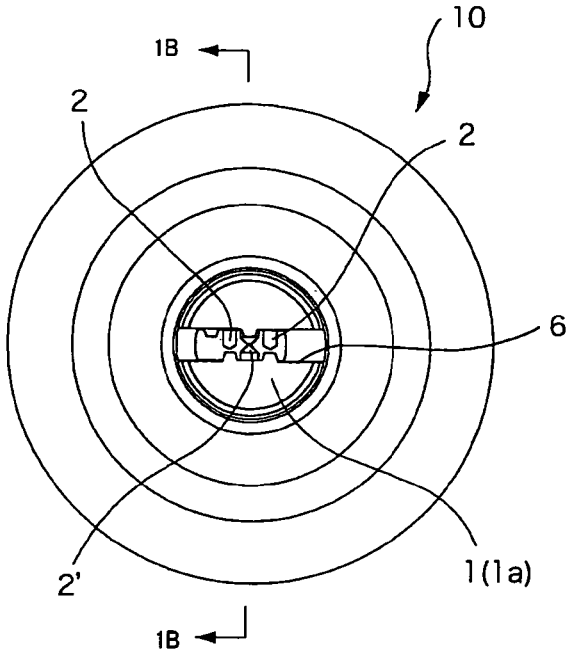
FIG. 1A is a front elevation of a cylinder lock according to one embodiment of the invention.
Figure 1B:
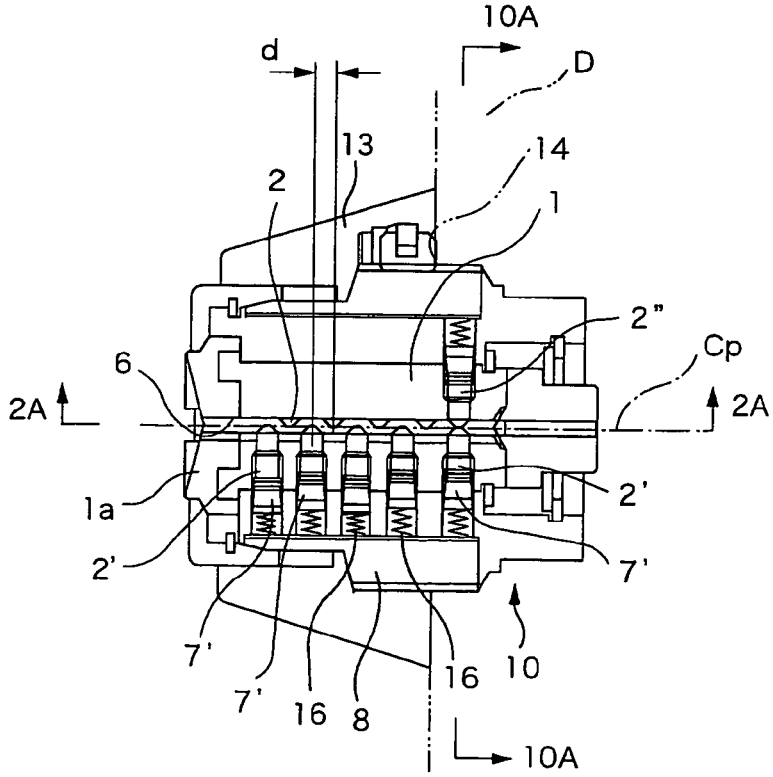
FIG. 1B is a sectional view taken along 1B-1B line of FIG. 1A.
Figure 2:
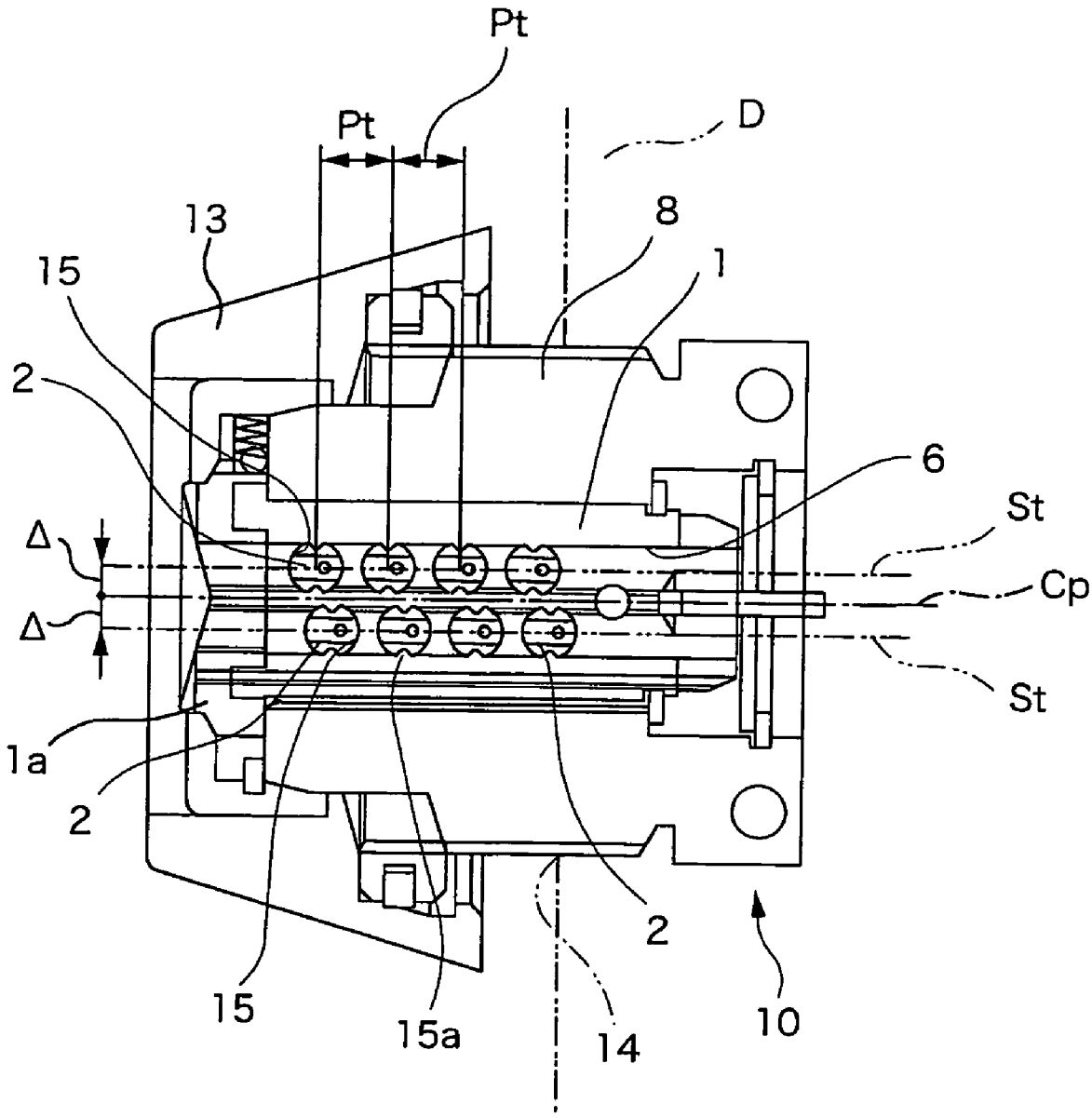
FIG. 2 is a sectional view taken along 2A-2A line of FIG. 1B.

FIG. 1A to FIG. 2 show a cylinder lock 10, which is fixed on a door body (D) and used for operating the lock body in the door body (D). The cylinder lock 10 is formed by inserting a plug 1 turnably into a cylinder case 8, and a cylindrical cover 13 is fitted in the front end portion of the cylinder case 8. The cylindrical cover 13 can be moved by a turning operation to the surface side of the door body (D). After the cylinder lock 10 was fixed in the state shown in FIG. 2 in the door body (D), the cylindrical cover can be fastened to cover a mounting hole 14 opened in the door body (D), as shown in FIG. 1B. Moreover, a cap member 1*a* is fitted in the front end of the plug 1.

Figure 4:
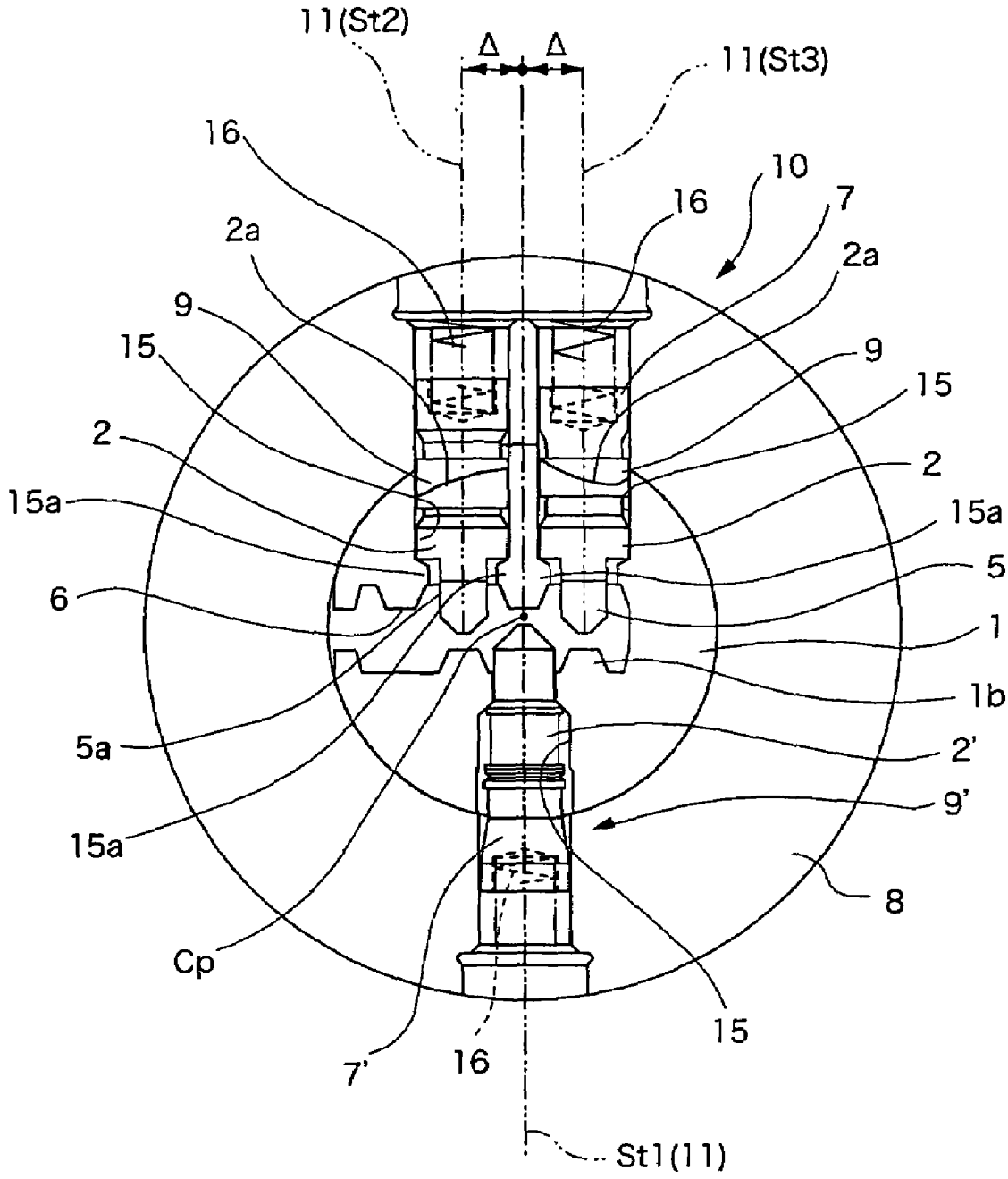
FIG. 4 is a sectional view of the cylinder lock taken along the center lines of the moving directions of tumbler pins and auxiliary tumbler pins.

In the center portion of the plug 1, as shown in FIGS. 2 and 4, there is opened a key insertion portion 6, which longitudinally extends of the plug 1. There are also formed a plurality of tumbler insertion holes 15, which are opened at one end in the key insertion portion 6 and at the other end in the outer circumference of the plug 1. Each tumbler insertion hole 15 is formed into a hole having a circular section and are provided with two tumbler turn restricting projections 15 a near the key insertion portion 6 and at two symmetric positions with respect to a center axis (as will be described as a moving direction center axis 11 because it is aligned with the moving direction center axis of tumbler pin 2) of the tumbler insertion hole 15.

As shown in FIG. 4, the moving direction center axis 11 of each tumbler insertion hole 15 is arranged normal to the widthwise center plane of the key insertion portion 6 and is arrayed to belong to any of a plurality of planes (i.e., tumbler row planes) parallel to the turning center of the plug 1. Equivalent spacings (Pt) are set between the key insertion portions 6 in the common tumbler row plane (St).

In this embodiment, totally three tumbler row planes (St1 to 3) are set two on one side and one on the other side with respect to the widthwise center plane of the key insertion portion 6. Of these three planes, one plane (St1) on the other side contains a turning center (Cp) of the plug, and two planes (St2 and St3) of one side are arranged at symmetric positions with respect to the tumbler row plane (St1) on the aforementioned other side. As a result, the two planes (St2 and St3) on one side are offset by (Δ) from the turning center (Cp) of the plug 1.

The aforementioned one plane (St1) on the other side is employed for constituting the master key system. This tumbler row plane (St1) employs the well-known tumbler pin (as will be called the "auxiliary tumbler pin 2'"), which has two generally frustum-conical ends to constitute an auxiliary locking portion 9' together with the later-described auxiliary drive pin 7'. The auxiliary tumbler pin 2' detects only the depth of unlocking code forming recesses 3 of the later-described unlocking key 4 thereby to decide the code. The turn restricting projection 15*a* is not provided in the tumbler insertion hole 15, into which the auxiliary tumbler pin 2' is to be inserted.

The tumbler pins 2 to be arrayed in the tumbler row planes (St2 and St3) on one side are shown in FIG. 5A to FIG. 5D. This tumbler pin 2 has a drive portion 5 having an outer circumference of a frustum-conical face on one end (For clarifying the description, the side on which the drive portion 5 is formed will be located on the lower side, and the opposite side will be located on the upper side.). The rotational center Ct (i.e., the rotational center at the time of rotating a generating line to acquire the conical shape) of the cone forming the drive portion 5 is offset by a predetermined spacing (δ) with respect to the moving direction center axis 11 of the tumbler pin 2. Moreover, the drive portion 5 has opposed chords cut off to have sections linearly symmetric with respect to the moving direction center axis 11, so that its opposed flat faces 5*a* are parallel to the plane which contains both the rotational center (Ct) of the cone and the moving direction center axis 11 of the tumbler pin 2. In this embodiment where the tumbler pin 2 turns 180 degrees to provide different unlocking codes, as will be described hereinafter, the flat faces 5*a* abut against the tumbler turn regulating projections 15*a*, when the key is inserted into the tumbler insertion hole 15, thereby to restrict the turning range of the tumbler pin 2.

At the upper end (i.e., at the end portion to contact with a drive pin 7) of the tumbler pin 2, on the other hand, there is formed a cylindrical curvature face 2*a* (i.e., a first cylindrical curvature face 2*a*). This cylindrical curvature face 2*a* has a radius of curvature (R) equal to the radius of the plug 1 and a center of curvature aligned with the turning center line (Cp) of the plug 1 when the curvature face coextends with the outer circumference of the plug 1.

Figure 5A:
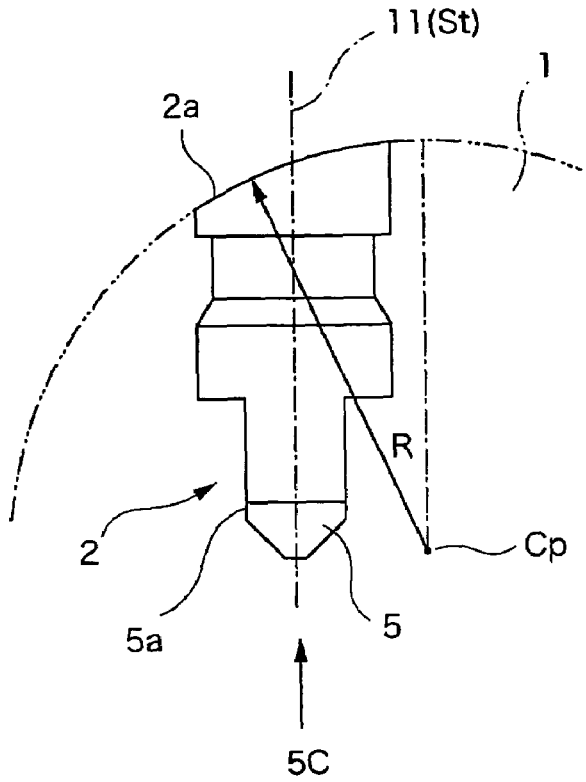
FIG. 5A is a front elevation of the tumbler pin.
Figure 5B:
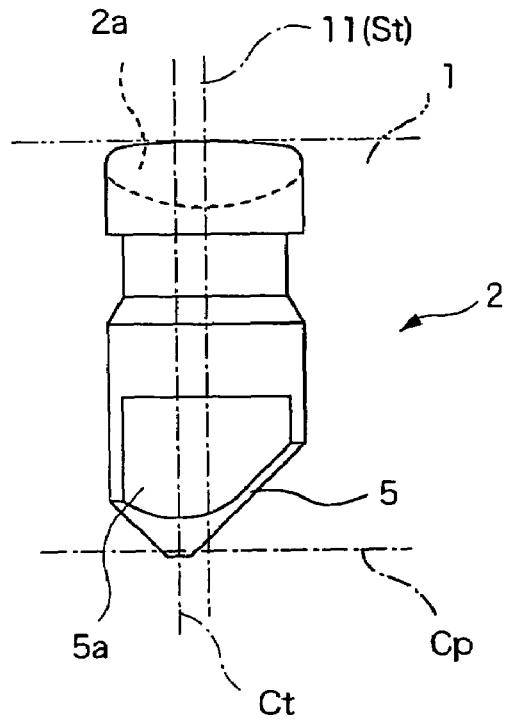
FIG. 5B is a side elevation of the tumbler pin.
Figure 5C:
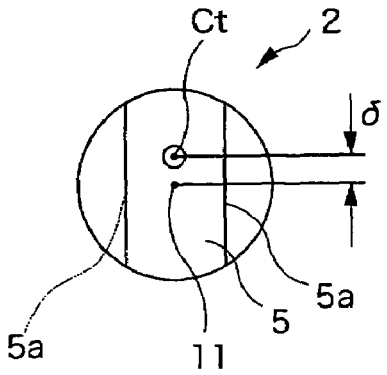
FIG. 5C is a view taken in the direction 5C of FIG. 5A.

For different locking codes, plural kinds (as will be called the "length factors") are set with the same shape but different lengths as that of the aforementioned tumbler pins 2, and turning factors for the different locking codes are added between the tumbler pins having identical length factors. The turning factors are made by varying the angle of intersection (i.e., the angle θ in FIG. 5D) on the plane (i.e., the projection plane) normal to the moving direction center axis 11 between the plane containing the rotational center (Ct) of the cone of the drive portion 5 and the moving direction center axis 11 and the plane containing the center line of the aforementioned cylindrical curvature face 2*a*. The angle θ can be varied from 0 degrees to 360 degrees in FIG. 5D. In this embodiment, six kinds of locking codes are set to 0 degrees, as shown in FIG. 5C, clockwise to 45 degrees (FIG. 5D), to 135 degrees, as vertically inverted from FIG. 5D, to 180 degrees, as vertically inverted from FIG. 5C, and to 225 and 315 degrees, as clockwise/counter-clockwise reversed from the former two.

Since the tumbler row planes (St2 and St3) on one side are arranged at the symmetric positions with respect to each other, as described above, the identical tumbler pins 2 are utilized as those having the different turning factors turned by 180 degrees, when they are employed at the symmetric positions.

In the cylinder case 8, on the contrary, there are arranged the drive pins 7 and 7', which have diameters substantially equal to those of the tumbler pin 2 and the auxiliary tumbler pin 2'. The drive pins 7 and 7' confront the tumbler pins 2 and 2', respectively, when the plug 1 is at the initial turning position (i.e., at the locking turning position) so that they can proceed into the tumbler insertion holes 15 on the side of the plug 1. The tumbler pins 2 and 2' can also proceed into the cylinder case 8. Moreover, the individual drive pins 7 are urged to the center portion of the plug 1 by compression springs 16.

At one end of the drive pin 7 corresponding to the tumbler pin 2 (i.e., at the end portion to contact with the tumbler pin), as shown in FIG. 4, there is formed a cylindrical curvature face (i.e., a second cylindrical curvature face), which coextends with the cylindrical curvature face 2*a* formed on the upper end of the tumbler pin 2. The well-known one having a frustum-conical shape at its leading end is employed as the auxiliary drive pin 7' corresponding to the auxiliary tumbler pin 2'. The boundaries between the tumbler pins 2 and the drive pins 7 constitute locking portions 9, and the boundaries between the auxiliary tumbler pins 2' and the auxiliary drive pins 7' constitute the auxiliary locking portions 9'.

Figure 3:
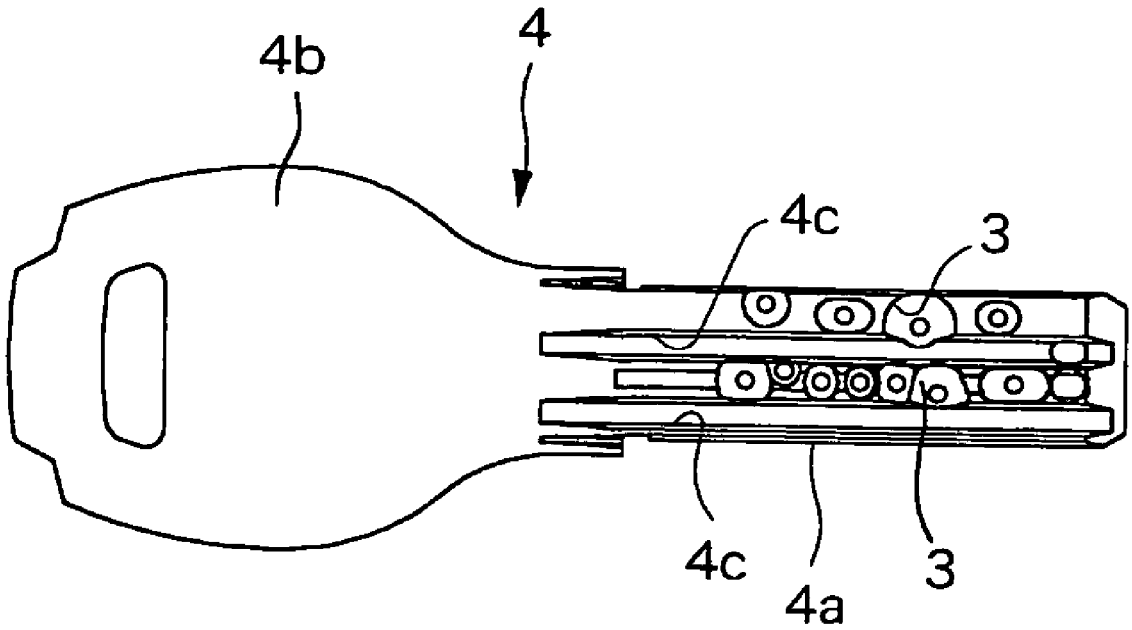
FIG. 3 is a top plan view of an unlocking key.

An unlocking key 4 for constituting the cylinder lock device together with the cylinder lock 10 thus constituted is shown in FIG. 3. The unlocking key 4 is formed to have a grip portion 4*b* at one end of a key blade portion 4*a*. The plural unlocking code forming recesses 3 are formed in a dimple shape in the two faces of the key blade portion 4*a*. For reversible uses, the key blade portion 4*a* is formed into a point-symmetry shape with respect to the intersection between the thickness center and the widthwise center while including the portion to form the unlocking code forming recesses 3. In FIG. 3, reference numerals 4*c* designate guide grooves, in which projections 1*b* formed on the plug 1 on the side of the key insertion portion 6 thereby to regulate the inserted position of the key in the plug 1.

Figure 9A:
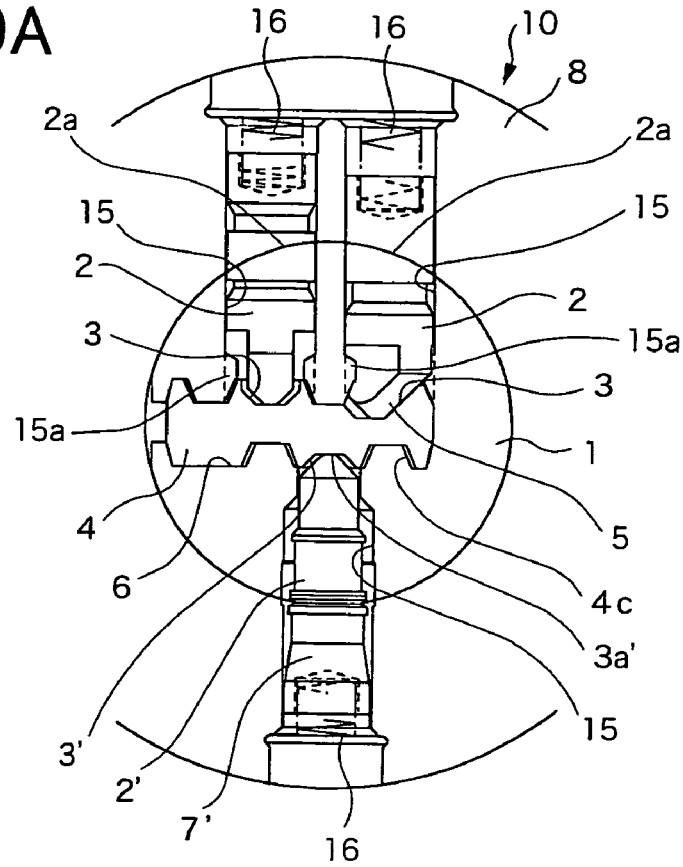
FIG. 9A is a view corresponding to FIG. 4 in the unlocked state, in which the unlocking key is inserted.
Figure 9B:
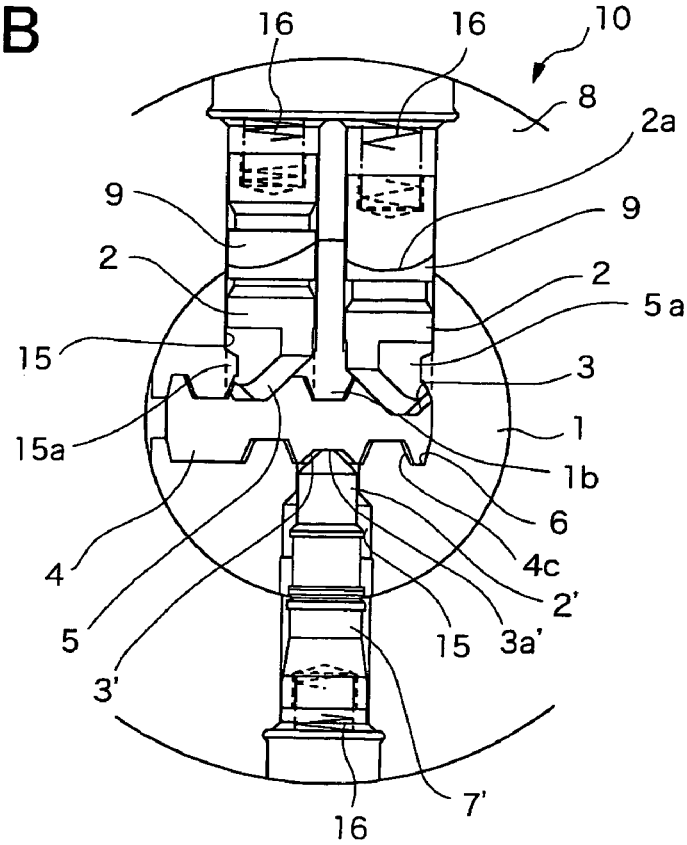
FIG. 9B is a view corresponding to FIG. 4 in the locked state, in which a key having no unlocking code formed is inserted.

Of the unlocking code forming recesses 3, the unlocking code forming recesses corresponding to the auxiliary tumbler pins 2' (as will be called the "auxiliary pin unlocking code forming recesses 3'") are formed to confirm the coincidence between the depth of the unlocking code forming recesses 3' and the auxiliary tumbler pins 2' by an abutment of the leading ends of the auxiliary tumbler pins 2' against bottom wall portions 3*a*'. As shown in FIG. 9A and FIG. 9B, the auxiliary pin unlocking code forming recesses 3' are formed by cutting the positions, where the centers of the bottom wall portions 3*a*' are aligned to the moving direction center axes 11 of the auxiliary tumbler pins 2', in the dimple shapes at the positions (i.e., the code decision positions), in which the unlocking key 4 is inserted to a normal position.

On the contrary, the unlocking code forming recesses 3 corresponding to the tumbler pins 2 are formed in the dimple shape having a circumferential wall for applying a turning torque to the tumbler pins 2 through the conical face in the drive portions 5 of the aforementioned tumbler pins 2. At the aforementioned circumferential wall, i.e., at the code decision position, the circumferential wall, which may abut against the drive portions 5 of the tumbler pins 2, is formed by the same conical faces as those of the drive portions 5.

Moreover, these unlocking code forming recesses 3 are set in a plurality of kinds having only different depths corresponding to the change in the lengths of the tumbler pins 2. The positions of the unlocking code forming recesses 3 are so set even in the shallowest codes having the minimum area in the concave areas on the surface of the unlocking key 4 that the rotational center (i.e., the frustum-conical face in this embodiment having the frustum-conical face) of the cone may be contained in the aforementioned recessed areas.

Figure 6:
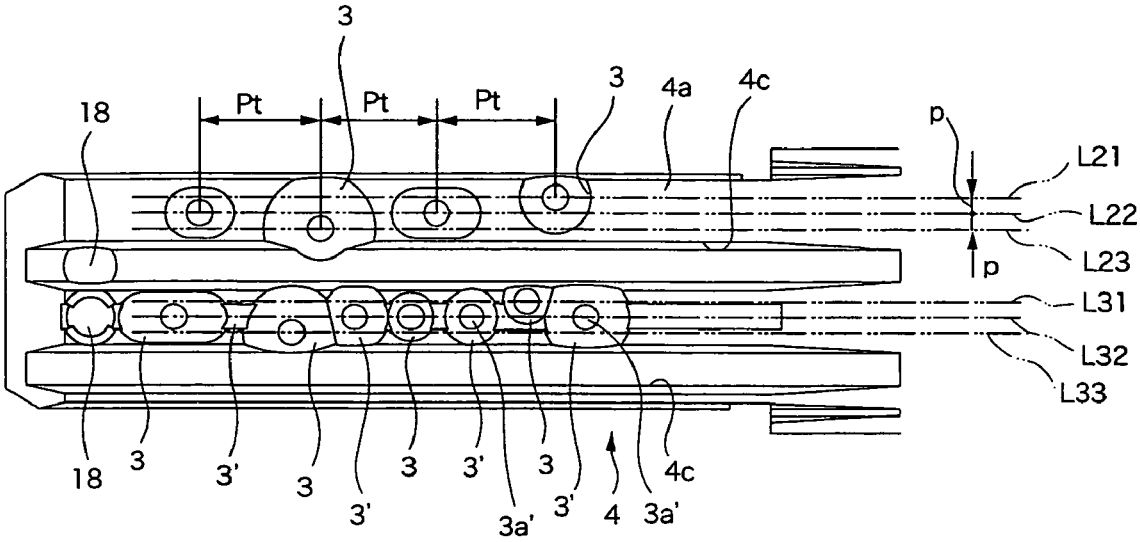
FIG. 6 is an enlarged view of a key blade portion of the unlocking key.

In order to manage the abutment positions and the depths of the drive portions 5 of the tumbler pins 2 easily, as will be described hereinafter, the unlocking code forming recesses 3 are arranged in the following manner. At first, totally six reference lines (L21, L22, L23, L31, L32 and L33) are so set three on the side faces of the unlocking key 4 as to correspond to the common tumbler row plane (St), as shown in FIG. 6 (although letters Lmn designate an n-th reference line of the tumbler row plane Stm). Reference lines L are straight lines parallel to the longitudinal direction of the unlocking key 4 and are arranged at an equal spacing (p) in the widthwise direction. The unlocking code forming recesses 3 are so arranged that the rotational centers of the conical faces may lie on any of the aforementioned reference lines (L) and that the spacing (Pt) between the adjoining rotational centers may be equal to that (Pt) between the adjoining tumbler insertion holes 15 in the common tumbler row plane (St) of the plug 1.

Figure 5D:
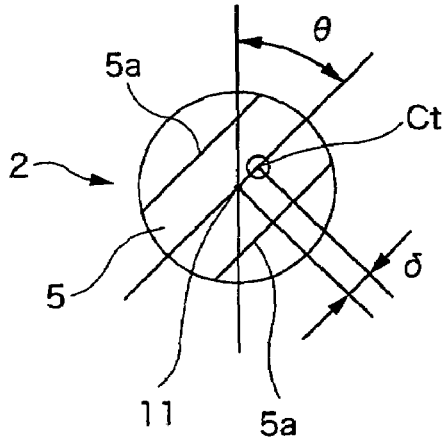
FIG. 5D is a view taken in the direction 5C of FIG. 5A and shows a key mistake.

If the generating lines of the conical faces of the unlocking code forming recesses 3 are unified by the aforementioned arrangement, the unlocking code forming recesses 3 on the reference lines (L) at the symmetric positions with respect to the reference lines (L22 and L32) positioned midway become, when they have equal depths, the unlocking codes which are inverted in the turning direction from the other side (which are vertically inverted in FIG. 5C and FIG. 5D). Since the turning positions of the tumbler pins 2 are determined by the positional relations between the moving direction center axes 11 and the rotational centers of the unlocking code forming recesses 3, as will be described hereinafter, three kinds of unlocking codes of the central and clockwise/counter-clockwise positions can be managed merely by selecting the reference lines (L). Depending upon the mounted position in the plug 1, moreover, it is possible to select the use of the front portions or the rear portions of the unlocking code forming recesses 3, i.e., the clockwise/counter-clockwise turned portions of FIG. 5C and FIG. 5D, thereby to set the unlocking codes of the totally six kinds with the common depth.

In this embodiment, moreover, the reference lines (L22 and L32) at the intermediate positions are symmetric with respect to the widthwise center line of the unlocking key 4, and one of them contains the turning center (Cp) of the plug 1. As a result, the unlocking code forming recesses 3 for the auxiliary pins belong to the reference line (L) common to the unlocking code forming recesses 3 and may overlap in positions. In order to prevent this overlap, the relative spacing (i.e., the size d in FIG. 1B) between the tumbler pins 2 and the auxiliary tumbler pins 2' is so determined that the unlocking code forming recesses 3 and the auxiliary pin unlocking code forming recesses 3'may be alternately arranged, as shown in FIG. 6.

In the description thus far made, the three reference lines (L) are made to correspond to the each tumbler row plane (St), but the number of reference lines may be two, or three or more. Moreover, the unlocking code forming recesses 3 to be arranged on the reference lines (L22 and L32) at the center portions are employed only at their substantial front and rear portions so that the circumferential walls can be-replaced by ellipses having an inclination like that of the remaining dimples, as shown in FIG. 6.

In this embodiment, therefore, while the unlocking key 4 is not being inserted, the drive pins 7 and 7' are so urged toward the center direction of the plug 1 by the compression springs 16 as to proceed into the tumbler insertion holes 15 of the plug 1, as shown in FIG. 4. In this state, the turning boundary between the plug 1 and the cylinder case 8 is closed so that the plug 1 cannot be turned (in the locked state).

Figure 7A:
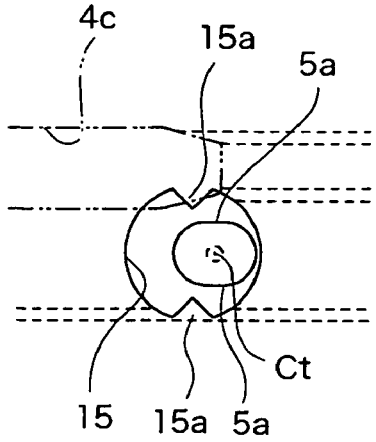
FIG. 7A is a sectional view taken along 7A-7A line of FIG. 7B.
Figure 7C:
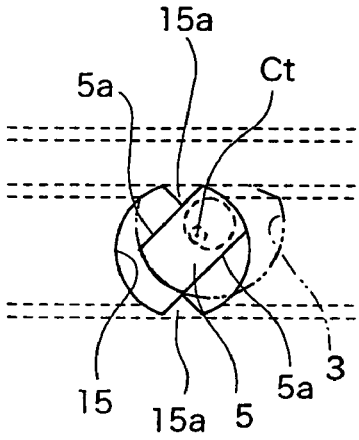
FIG. 7C is a sectional view taken along 7C-7C line of FIG. 7D.
Figure 7B:
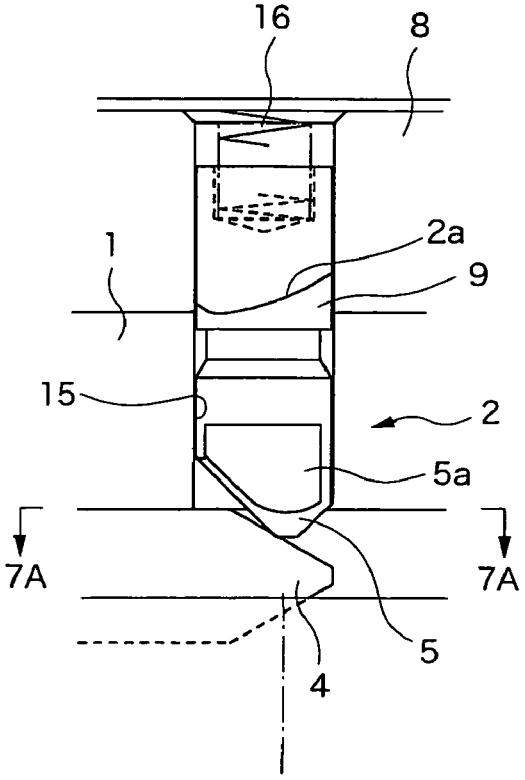
FIG. 7B is a view showing the state, in which the tumbler pin is pushed up by the unlocking key.
Figure 7D:
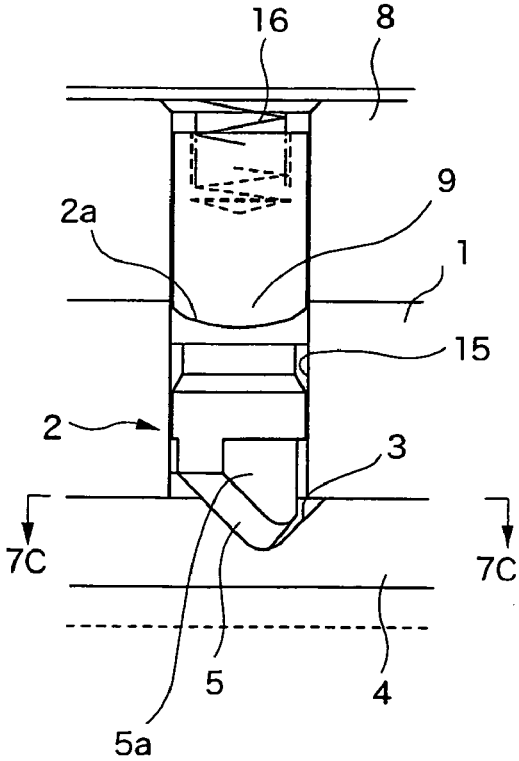
FIG. 7D is a view showing the fitted state in an unlocking code forming recess.
Figure 8A:
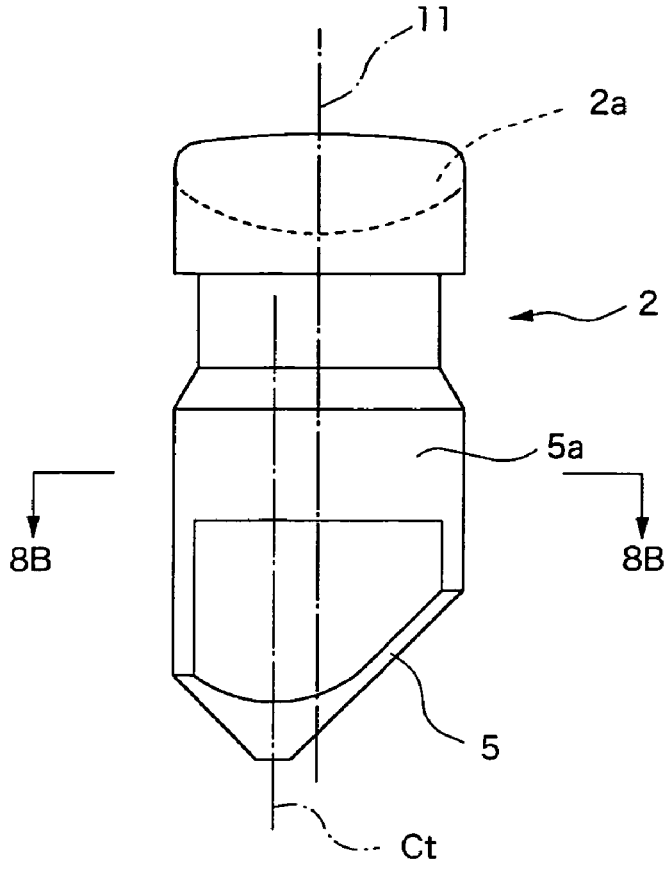
FIG. 8A is a side elevation of the tumbler pin.
Figure 8B:
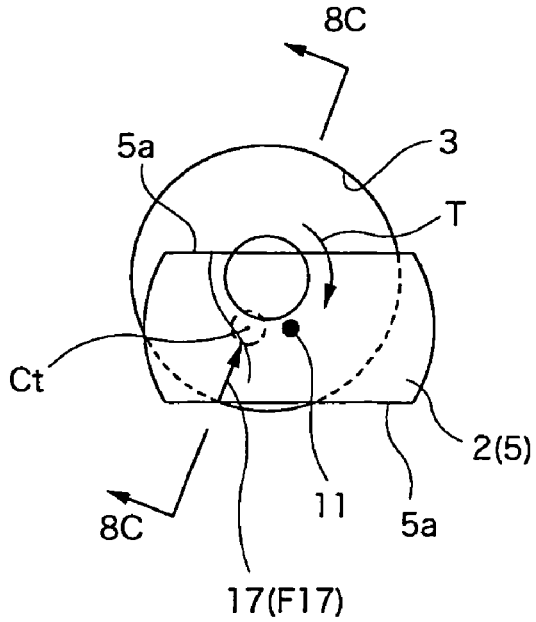
FIG. 8B is a sectional view taken along 8B-8B line of FIG. 8A and shows an early fitted state in the unlocking code forming recess.
Figure 8C:
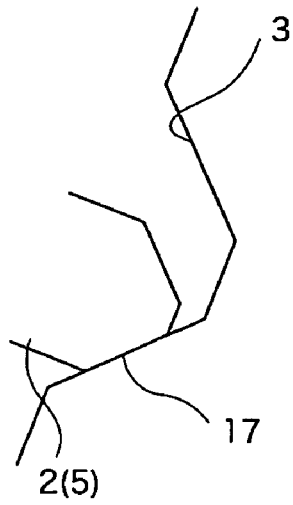
FIG. 8C is a sectional view taken along 8C-8C line of FIG. 8B.

When the unlocking key 4 is inserted, the lower end of the tumbler pin 2 is brought at first upward by the leading end of the unlocking key 4, as shown in FIG. 7A and FIG. 7B. When the unlocking key 4 is then inserted to the code decision position, as shown in FIG. 7C and FIG. 7D, the drive portion 5 of the tumbler pin 2 comes into abutment against the circumferential edge of the unlocking code forming recess 3. Since the urging force in the protruding direction is applied to the tumbler pin 2, a component (F17) toward the center direction of the unlocking code forming recess 3 is created on a contact line 17 of the tumbler pin 2 with the circumferential edge 3 of the unlocking code forming recess 3, as shown in FIG. 8A to FIG. 8C. Since the moving direction center axis (or point) 11 of the tumbler pin 2 is not contained by the action line of the component (F17) thus created, a turning force (T) in a predetermined direction (i.e., in the clockwise direction, as shown) is created in the tumbler pin 2 so that the tumbler pin 2 is turned to a predetermined rotational position.

Thus, the turning angle of the tumbler pin 2 is univocally determined by the state of the unlocking code forming recesses 3. If the unlocking code forming recesses 3 are genuine, the cylindrical curvature face 2*a* at the upper end of the tumbler pins 2 are completely identical to the turning boundary between the plug 1 and the cylinder case 8, as shown in FIG. 9A, so that the plug 1 can be turned.

In case the turning angle is improper, on the contrary, the boundary between the tumbler pins 2 and the drive pins 7 proceed, as shown in FIG. 9B, even with the equal depths so that the plug 1 cannot be turned.

In this embodiment, therefore, not only the length of the tumbler pins 2 but also the turning angle becomes the different locking codes so that the number of codes drastically increases. In this embodiment, moreover, floating balls 18 for making the copies difficult are fitted in the unlocking key 4. For the reversible uses, as described hereinbefore, two floating balls 18 are arranged on the guide grooves 4*c* at the terminal end portion of the unlocking key 4.

Figure 10:
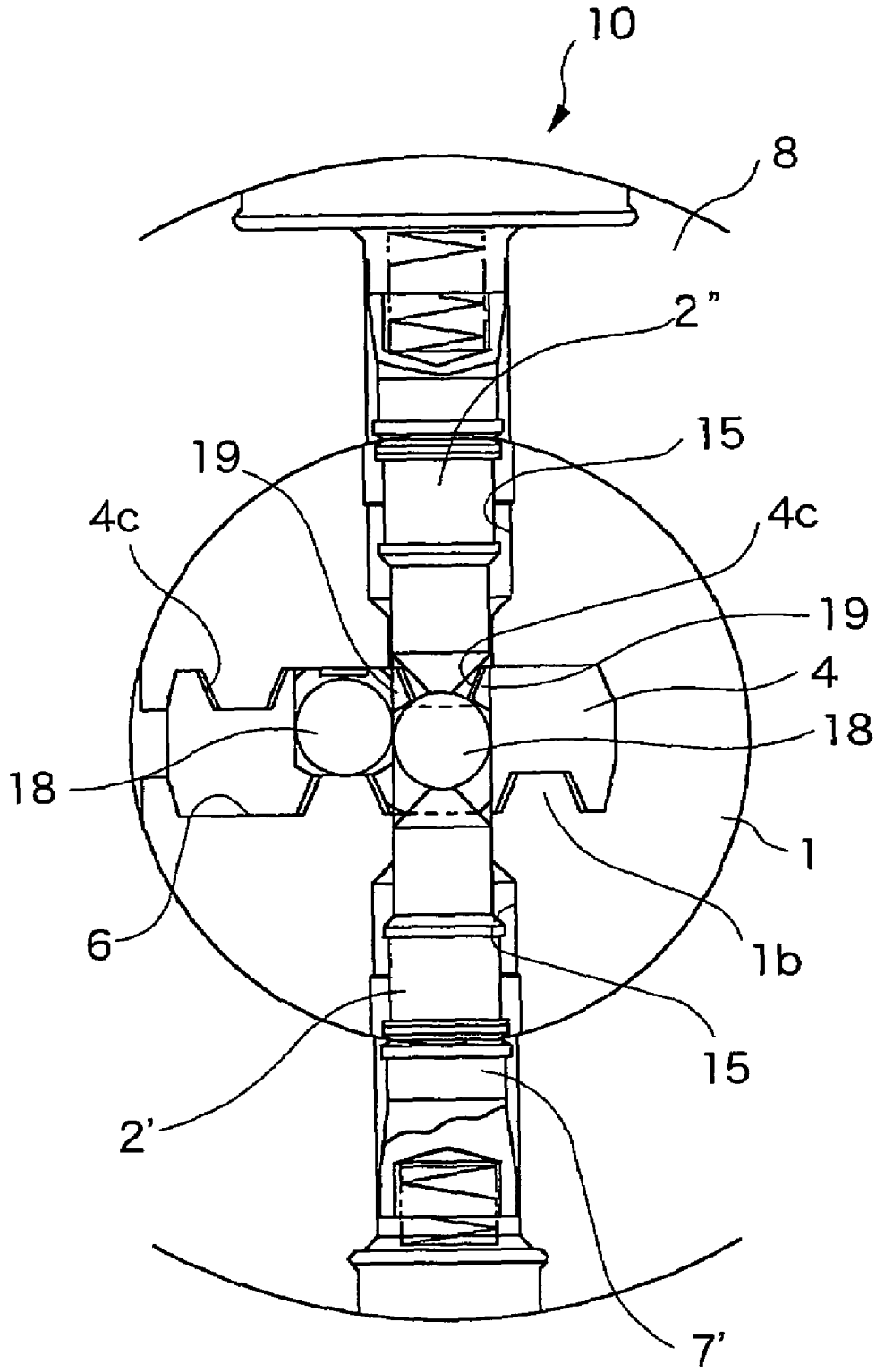
FIG. 10 is a sectional view taken along 10A-10A of FIG. 1B, in which the unlocking key is inserted.

This floating ball 18 is pushed onto a support projection 19 by one auxiliary tumbler pin 2' in the plug 1, as shown in FIG. 10. In order to ensure the push of the floating ball 18 onto the auxiliary tumbler pin 2', a higher urging force than that-to the other auxiliary tumbler pin 2" arranged to confront the auxiliary tumbler pin 2' is applied to the drive pin 7' on the side of the auxiliary tumbler pin 2'. In this state, the boundary between the auxiliary tumbler pin 2' and the corresponding drive pin 7' becomes identical to the turning boundary of the plug 1.

In case the unlocking key 4 having no floating ball 18 is inserted, on the contrary, the drive pin 7' corresponding to one auxiliary tumbler pin 2' proceeds into the plug 1 so that the locked state is established. If the holding positions of the two auxiliary tumbler pins 2' and 2" of the floating balls 18 are formed in the unlocking key 4, on the other hand, the boundary between the floating ball 18 and the other auxiliary tumbler pin 2" takes a position popped out of the guide groove 4*c*, as shown in FIG. 10, so that the unlocking key 4 cannot be inserted into the tumbler insertion holes 15.

As a result, even if the unlocking key 4 is acquired, the unlocking cannot be achieved merely by tracing the profile so that the unlocking key 4 cannot be copied.

Embodiment 2

Figure 11:
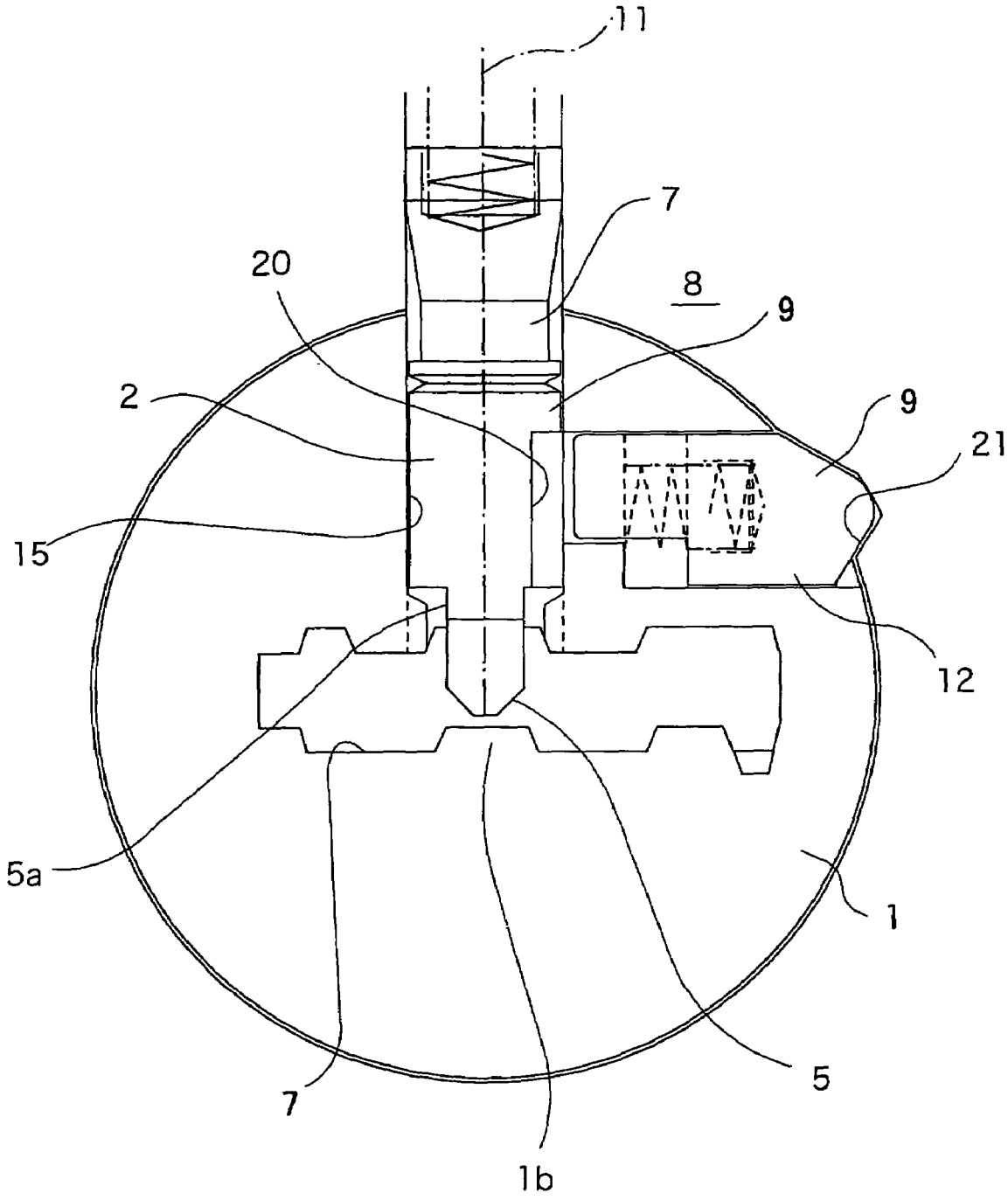
FIG. 11 is a sectional view showing another embodiment of the invention.

FIG. 11 shows another embodiment of the invention. In this embodiment, the locking portion 9 is constituted to include the tumbler pins 2 and a side bar 12. The upper ends of the tumbler pins 2 and the leading ends of the drive pins 7 are formed like the auxiliary tumbler pins 2' into the frustum-conical shape. Moreover, the tumbler pins 2 are provided at their lower ends with the drive portions 5 and in their side walls with relief grooves 20 over a predetermined length.

The numeral 12 designates the side bar, which is so moved perpendicularly of the moving direction center axis 11 as to go into and out of the tumbler insertion hole 15. The cylinder case 8 is provided with a stopper groove 21, which confronts the side bar 12 when the plug is at the turned locking position.

In case the unlocking code forming recesses 3 have different depths, the boundary between the tumbler pins 2 and the drive pins 7 urged toward the center by the compression springs 16 do not coincide with the turning boundary of the plug 1 so that the locked state is kept. Even if the depth of the unlocking code forming recesses 3 is genuine so that the boundary between the tumbler pins 2 and the drive pins 7 coincides with the turning boundary of the plug 1, the relief groove 20 does not confront the side bar 12 so that the side bar 12 cannot retract into the plug 1. As a result, the turning boundary between the plug 1 and the cylinder case 8 is not released but kept in the locked state.

It will be apparent to those skilled in the art that various modifications and variations can be made to the described preferred embodiments of the present invention without departing from the spirit or scope of the invention. Thus, it is intended that the present invention cover all modifications and variations of this invention consistent with the scope of the appended claims and their equivalents.

What is claimed is:

1. A cylinder lock comprising:

a cylinder case;

a cylindrical plug turnably inserted into the cylinder case;

a tumbler pin held in the plug and enabled to proceed into the cylinder case and to turn on a moving direction center axis that is offset from a turning center of the plug;

a drive pin held in the cylinder case and enabled to proceed into the plug and to turn on the moving direction center axis;

a first cylindrical curvature face formed at an end portion of the tumbler pin to make contact with the drive pin and having a radius of curvature equal to a diameter of the plug and a center of curvature on a rotational center line of the plug; and a second cylindrical curvature face formed on an end portion of the drive pin to make contact with the tumbler pin and coextending with the first cylindrical curvature faces.

2. The cylinder lock according to claim 1, further comprising:

a drive portion formed at another end portion of the tumbler pin on a side of a key insertion portion of the plug and having a conical face gradually reduced in diameter toward a leading end, wherein a rotational center of the conical face is offset from the moving direction center axis.

3. An unlocking key insertable into the plug of the cylinder lock according to claim 1, in which the tumbler pin is movably mounted in the plug so that a locked/unlocked state of the cylinder lock is determined by a turning position of the tumbler pin on the moving direction center axis, wherein the tumbler pin includes a flat face which is parallel to the moving direction center axis, and a turning range of the tumbler pin is restricted by the flat face engaging a tumbler turn regulating projection, the unlocking key comprising:

an unlocking code forming recess, wherein the unlocking code forming recess is formed into a conical face having a rotational center on one row of a plurality of rows parallel to an insertion direction of the unlocking key into the plug.

4. The unlocking key of claim 3, wherein the rows are three in number, and the rotational center is arranged on one selected in a predetermined order from the three rows.

5. The unlocking key according to claim 3, wherein the flat face is parallel to a plane containing both the moving direction center axis and the rotational center of the conical face of the drive portion.

6. A cylinder lock device comprising:

a cylinder lock having a tumbler pin movably mounted in a plug, wherein a locked/unlocked state of the cylinder lock is determined by a turning position of the tumbler pin around a moving direction center axis; and an unlocking key adapted to be inserted into the plug and having an unlocking code forming recess for determining the turning position of the tumbler pin at a code decision position, wherein the tumbler pin is provided at a leading end portion with a drive portion, the drive portion having a conical face as an outer circumference gradually reduced in diameter toward the leading end, wherein a rotational center of the conical face of the drive portion is offset from the moving direction center axis, the unlocking code forming recess is provided with a conical face as an inner circumference having a rotational center substantially aligned with the rotational center of the conical face of the drive portion, at the code decision position, the conical face of the drive portion is forced to make contact with the conical face of the unlocking code forming recess so as to determine the turning position of the tumbler pin, wherein the tumbler pin includes a flat face which is parallel to the moving direction center axis, and a turning range of the tumbler pin is restricted by the flat face engaging a tumbler turn regulating projection.

7. The cylinder lock according to claim 6, wherein the flat face is parallel to a plane containing both the moving direction center axis and the rotational center of the conical face of the drive portion.

8. A cylinder lock comprising:

a plug including a key insertion portion and a tumbler pin, wherein the key insertion portion is longitudinally formed at a center portion of the plug, the tumbler pin is movable in a direction into and out of the key insertion portion, and the tumbler pin is turnable on a moving direction center;

a cylinder case into which the plug is turnably inserted, wherein a drive pin for applying an urging force to the tumbler pin toward a protruding side to the key insertion when the plug is at an initial turning position; and a locking portion for opening/closing a turning boundary between the plug and the cylinder case in accordance with a turning position of the tumbler pin, wherein the tumbler pin is provided, at an end position on a side of the key insertion portions, with a drive portion having a conical face gradually reduced in diameter toward a leading end, and a rotational center of the conical face of the drive portion is offset from the moving direction center axis, wherein the tumbler pin includes a flat face which is parallel to the moving direction center axis, and a turning range of the tumbler pin is restricted by the flat face engaging a tumbler turn regulating projection.

9. The cylinder lock according to claim 8, wherein the locking portion comprises contact side end portions respectively provided on the tumbler pin and the drive pin between the tumbler pin and the drive pin, and respective contact end faces between the tumbler pin and the drive pin are formed of curvature faces coincident with the cylindrical turning boundary between the plug and the cylinder case.

10. The cylinder lock according to claim 8, wherein the flat face is parallel to a plane containing both the moving direction center axis and the rotational center of the conical face of the drive portion.

* * * * *